US009840945B2

(12) United States Patent
Weber et al.

(10) Patent No.: US 9,840,945 B2
(45) Date of Patent: Dec. 12, 2017

(54) ANTI-TWIST PROTECTION FOR THE INNER PART OF A SPLIT ROTOR FOR A HYDRAULIC CAMSHAFT ADJUSTER

(71) Applicant: Schaeffler Technologies AG & Co. KG, Herzogenaurach (DE)

(72) Inventors: Juergen Weber, Erlangen (DE); Christian Boesel, Rednitzhembach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 5 days.

(21) Appl. No.: 15/101,643

(22) PCT Filed: Oct. 22, 2014

(86) PCT No.: PCT/DE2014/200586
§ 371 (c)(1),
(2) Date: Jun. 3, 2016

(87) PCT Pub. No.: WO2015/090299
PCT Pub. Date: Jun. 25, 2015

(65) Prior Publication Data

US 2016/0305292 A1 Oct. 20, 2016

(30) Foreign Application Priority Data

Dec. 18, 2013 (DE) ..... 10 2013 226 460

(51) Int. Cl.
*F01L 1/34* (2006.01)
*F01L 1/344* (2006.01)

(52) U.S. Cl.
CPC ... *F01L 1/3442* (2013.01); *F01L 2001/34423* (2013.01); *F01L 2103/00* (2013.01)

(58) Field of Classification Search
CPC ..... F01L 1/3442; F01L 2001/34423; F01L 2103/00
USPC ..... 123/90.17
See application file for complete search history.

(56) References Cited

U.S. PATENT DOCUMENTS

| | | | |
|---|---|---|---|
| 7,640,902 | B2 | 1/2010 | Knecht et al. |
| 8,490,589 | B2 | 7/2013 | Arnold |
| 8,550,046 | B2 | 10/2013 | Terfloth et al. |
| 8,578,899 | B2 | 11/2013 | Ottersbach et al. |

(Continued)

FOREIGN PATENT DOCUMENTS

| | | |
|---|---|---|
| DE | 102008028640 | 12/2009 |
| DE | 102009031934 | 1/2011 |

(Continued)

*Primary Examiner* — Zelalem Eshete
(74) *Attorney, Agent, or Firm* — Davidson, Davidson & Kappel, LLC

(57) ABSTRACT

A multi-part rotor (1) for a hydraulic camshaft adjuster, including two partial rotor members (2) which rest against each other along a separation plane (3) extending perpendicular to the axial direction and which jointly define hydraulic medium ducts (4) extending within said separation plane (3) and, including an additional rotor member (5) that conducts hydraulic medium from opposite axial directions in a targeted manner to different hydraulic medium ducts (4). The additional rotor member (5) or at least one positively engaging anti-twist element (6) is secured to one or both partial rotor members (2) for conjoint rotation therewith.

10 Claims, 7 Drawing Sheets

(56) References Cited

U.S. PATENT DOCUMENTS

| | | | | |
|---|---|---|---|---|
| 8,857,390 | B2 | 10/2014 | Malen et al. | |
| 9,284,862 | B2 | 3/2016 | Frey | |
| 2012/0222638 | A1* | 9/2012 | Arnold | F01L 1/3442 123/90.17 |

FOREIGN PATENT DOCUMENTS

| | | |
|---|---|---|
| DE | 102009053600 | 5/2011 |
| DE | 102011117856 | 5/2013 |
| DE | 102012208495 | 11/2013 |
| EP | 1731722 | 12/2006 |
| WO | WO2009152987 | 12/2009 |
| WO | WO2010128976 | 11/2010 |
| WO | WO2013164272 | 11/2013 |

* cited by examiner

ANTI-TWIST PROTECTION FOR THE INNER PART OF A SPLIT ROTOR FOR A HYDRAULIC CAMSHAFT ADJUSTER

The present invention relates to a multipart rotor for a hydraulic camshaft adjuster, which includes two rotor partial bodies which rest against one another on a separating plane that is oriented perpendicularly with respect to the axial direction. The one rotor partial body may also be referred to as a rotor main body, and the other rotor partial body may be referred to as a first rotor secondary body, or both may be referred to as rotor halves. However, further components or at least one further component together with the rotor halves form the multipart rotor, the rotor partial bodies together defining hydraulic medium-conducting channels which extend in the separating plane. The multipart rotor includes a rotor additional body, which may also be referred to as a second rotor secondary body, which conducts hydraulic medium in a targeted manner from opposite axial directions to different hydraulic medium-conducting channels.

The rotor main body could also be referred to as a central body or cup-shaped body. The hydraulic medium-conducting channel could also be referred to as an oil channel when pressure oil/oil is used as the hydraulic medium.

BACKGROUND

Multipart rotors for hydraulic camshaft adjusters of the vane cell type are already known from the prior art. Thus, for example, rotor halves are joined with pins and/or sintered. It is known to mount two plastic rotor parts on a steel support, and to additionally glue two rotor parts which are joined thereto. In addition, rotor parts may ensure a connection by nested geometries that are adapted to one another. Furthermore, it is possible to provide two rotor halves which seal off oil channels via sintered facets. It is also known to design the rotor as a composite system in which a rotor core in addition to a cover forms oil channels. The use of a form fit and a press fit in oil channels is likewise known in principle.

Thus, for example, DE 10 2009 031 934 A1 provides a camshaft adjuster which includes a stator and a rotor, situated in the stator, which includes vanes, each of which is situated in a chamber formed between the stator and the rotor, the vanes dividing their respective chamber into two subchambers, and pressure oil being suppliable to and dischargeable from each subchamber via oil channels, so that the pressure oil may exert a torque on the rotor. Due to this configuration, the rotor is rotatable and adjustable for the camshaft adjustment, the rotor being made of a metallic base structure which includes a plastic liner, axially adjacent thereto, in which at least one of the oil channels is formed.

A two-part rotor is also known from WO 2010/128976 A1 which includes a sleeve part that is concentric with respect to a main body which forms a vane, the hydraulic medium-conducting channels formed as oil channels being present in the sleeve part.

Another hydraulic camshaft adjuster is known from DE 10 2008 028 640 A1. The cited publication describes a hydraulic camshaft adjuster which includes a drivable outer body having at least one hydraulic chamber, and an inner body which is situated internally with respect to the outer body and fixedly connectable to a camshaft, and which includes at least one swivel vane which extends radially into the hydraulic chamber, thus dividing the hydraulic chamber into a first and a second working chamber. The inner body also includes at least one oil supply line and one oil discharge line which extend from a casing interior to a casing exterior of the inner body, up to one of the two working chambers. The inner body is made up of at least one first element and one second element, each of the two elements at mutually facing front sides having a geometry which, together with the respective other element, forms the oil supply line and the oil discharge line of the inner part.

A multipart joined rotor for hydraulic camshaft adjusters having joint sealing profiles is also known from DE 10 2011 117 856 A1. The described camshaft adjusting device for internal combustion engines and a method for manufacturing same relate to a stator wheel and a rotor wheel which cooperates with the stator wheel. The stator wheel is driven in rotation about a rotation axis, the rotor wheel being connectable to a camshaft of the internal combustion engine, and in addition the stator wheel including radially inwardly facing stator vanes, between which radially outwardly facing rotor vanes (which define the vane cells) situated on the rotor wheel extend, so that fluid chambers/working chambers A and B are formed between the stator vanes and the rotor vanes, and which may be acted on with a pressure fluid via fluid channels, the rotor wheel including a first partial body and a second partial body, a joining surface of the first partial body and a joining surface of the second partial body being joined together, and depressions being introduced into at least one of the two joining surfaces in order to form the fluid channels, at least at spaced intervals. To provide a camshaft adjusting device which includes a rotor wheel that is formed from two partial bodies which are joined together, in the cited publication it is provided that the fluid channels are sealed off, and that a defined contact of the brought-together joining surfaces is created.

A camshaft adjuster which operates according to the swivel motor principle, which means that it is able to move back and forth at a certain angle, generally includes a stator and a rotor, as also provided in EP 1 731 722 A1, for example. The rotor itself is provided as a composite system made up of at least two components. One of the components is a cover. The other component of the composite system may be referred to as a rotor core. The cover is placed on the rotor.

Another hydraulic camshaft adjuster is known from WO 2009/1252987 A1.

The rotor in DE 10 2009 053 600 A1 has also proven to be easy to manufacture and robust under load. The cited publication provides a rotor, in particular for a camshaft adjuster, which includes a rotor base body having a hub part with a central oil supply line. At least one vane which is radially situated in the hub part, and an oil channel which extends through the hub part on both sides of a vane and which is fluidically connected to the central oil supply line, is provided in the hub part. The manufacture of the rotor base body is greatly simplified by dividing the rotor base body along a parting line so that it is made up of two base body parts. Journals or pins are inserted for joining the two rotor halves together. The journals are provided at one of the two rotor halves, and engage with recesses in the other rotor half.

SUMMARY OF THE INVENTION

However, the previous approaches have disadvantages with regard to costs, for example due to the provision of connecting pins or the need for keeping adhesives on hand which are additionally or exclusively used. In addition, hazardous materials are frequently involved which should be avoided. Furthermore, the connection obtained is often not robust enough for the requirements of the customer. In addition, when longitudinal press fits, heretofore common at certain locations, are used, component deformations occur which should be avoided. Also, there is always a risk of the rotor jamming in the stator. The previous approaches are also not sufficiently secured against leaks. Furthermore, cracks or other component damage may occur during operation which result(s) in failure of the hydraulic camshaft adjuster.

One object of the present invention is to eliminate or at least minimize the stated disadvantages, for example to provide a rotor variant that is cost-effective and easy to manufacture, and also particularly long-lasting.

For a generic rotor, the present invention provides that the rotor additional body is secured in a rotatably fixed manner to one or both rotor partial bodies via at least one anti-twist element which acts in a form-fit manner.

In other words, an angle-oriented form-fit, force-fit, or integral bond connection between the rotor additional body, designed as an oil distribution sleeve, and at least one of the rotor partial bodies is used. The form-fit connection is favored here.

It is advantageous when the anti-twist element is designed as an integral projection or as a recess at the outer circumferential surface of the rotor additional body which cooperates in a form-fit manner with an anti-twist counterelement having a corresponding geometric design, such as a depression or an integral elevation, of one or the other rotor partial body or both rotor partial bodies. Such anti-twist elements and anti-twist counterelements may be easily introduced during manufacture, and are precise in such a way that twisting in the rotor is prevented.

It is advantageous for the rotor additional body and/or the two rotor partial bodies to have a ring-like design. It is then easy to ensure the oil supply from within, using a central valve/a central screw, for example.

To achieve a compact rotor, it is advantageous when the two rotor partial bodies are fitted together essentially congruently in the axial direction, and the rotor additional body is situated concentrically and radially within the two components and preferably additionally secured via a force-fit connection such as a longitudinal press fit.

To ensure that oil always passes from one opening in the central valve into one working chamber, and always passes from another opening in the central valve into another working chamber, in a targeted manner, it is advantageous when the rotor additional body includes oil-conducting pockets at the outer circumference which have a design that is open in alternation over the circumference, facing in different axial directions.

The hydraulic resistance when the oil is conducted should be kept low when a rotor partial body includes at least one oil-conducting counterpocket, in the form of a depression, which at the inner circumferential surface leads to a hydraulic medium-conducting channel. Such depressions may also be present between elevations or ribs.

It is advantageous when both rotor partial bodies include at least one oil-conducting counterpocket which protrudes/is oriented in different/opposite axial directions away from the hydraulic medium-conducting channel. It is then possible to ensure a targeted supply of oil from the one opening in the central valve to the one hydraulic medium-conducting channel, and from the other opening in the central valve to the other hydraulic medium-conducting channel.

In addition, it is advantageous when the oil-conducting counterpocket extends beyond the axial edge of the rotor additional body. Enough room is then present for the oil supply.

In addition, it is advantageous when the oil-conducting counterpocket extends by approximately 10% to 100% or by more than approximately 10%, 20%, or 25%, for example 50% to 100%, of the distance from an edge of a hydraulic medium-conducting channel remote from the separating plane to the front edge of the rotor additional body present on this side of the separating plane, in the direction of the front side of one of the rotor partial bodies present on this side of the separating plane. The fluid flow is kept particularly constant, and the manufacture is simplified, by such a variant.

Advantageous exemplary embodiments are also characterized in that the oil-conducting counterpocket extends to a front side of the rotor partial body, remote from the separating plane, at which the oil-conducting counterpocket is formed.

It is also advantageous when one, two, or three component(s) of the group made up of the two rotor partial bodies and the rotor additional body is/are made of a metallic and/or ceramic sintered material, a steel alloy, a light alloy, or a plastic. Other materials or sintered materials are also usable, as well as mixtures of different starting materials.

One advantageous exemplary embodiment is also characterized in that two or all components of the group made up of both rotor partial bodies and the rotor additional body are made of different materials or have different densities, hardnesses, and/or porosities.

To allow at least the rotor partial bodies to be manufactured without cutting, it is advantageous when they are made of sintered material, for example metallic sintered material, and for allowing them to be manufactured at the same time, it is advantageous when they are geometrically identical and the rotor additional body is designed as a cold-formed, possibly deep-drawn and/or punched steel component, since this allows the costs to be reduced, and the loads transmitted from the camshaft to be well absorbed.

One advantageous exemplary embodiment is also characterized in that the two rotor partial bodies are caulked and/or pinned together.

The oil-conducting function is efficiently achieved when the rotor additional body has an L- or C-shaped cross section.

For the pinning, it is advantageous when the connection of the two rotor halves is established by long spring suspension pins, for example one to four such pins, and/or by short connecting pins that are shorter than the rotor width measured in the axial direction.

The form-fit connection may be easily achieved when at least one radial elevation and one depression are present (in alternation) on/in the outer diameter of the oil distribution sleeve, for example extending/alternating over the circumference.

It is advantageous when at least one radial elevation or depression on the inner diameter of the rotor half is present as a counter contour with respect to the elevation/depression on the oil distribution sleeve.

To allow a "poka-yoke" measure to be easily implemented, it is advantageous when two anti-twist elements and anti-twist counterelements are present in an asymmetrical arrangement with respect to one another, radially protruding from same or pressed into same, for example at an angle <180° on opposite sides of the rotor additional body, for example at a 160° angle. Values of 110°, 120°, 150°, and 160° are options. Of course, it is also possible to offset the two anti-twist elements, designed as projections, by 180° with respect to one another.

A multiple use of the oil distribution sleeve in the outlet/inlet rotor due to a mirror-image configuration of the form-fit connection in the rotor halves is advantageous.

It is optionally possible to use a press fit which acts between the outer diameter of the oil distribution sleeve and the inner diameter of one or both rotor halves. The oil distribution sleeve may then be joined with an angled orientation.

Sinter brazing or laser welding is optionally possible in order to position the oil distribution sleeve in the rotor half. The oil distribution sleeve is then to be joined with an angled orientation.

A three-part rotor having a functionally reliable design is provided in this way.

BRIEF DESCRIPTION OF THE DRAWINGS

The present invention is explained in greater detail below with the aid of the drawings, which illustrate various exemplary embodiments.

DETAILED DESCRIPTION

Figure 1:
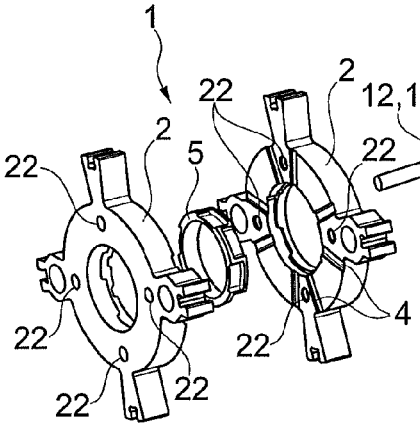
FIG. 1 shows an exploded view of a first specific embodiment according to the present invention.

The figures are merely schematic, and are used only for an understanding of the present invention. Identical elements are provided with the same reference numerals. Elements of the individual exemplary embodiments may be interchanged with one another.

Figure 3:
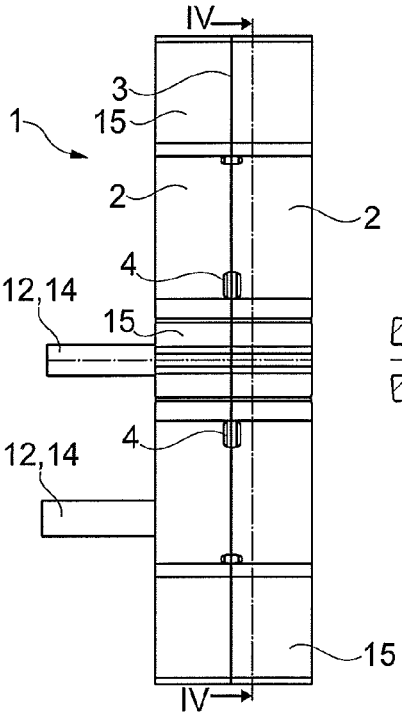
FIG. 3 shows a side view of the metallic rotor configuration from FIG. 1, also connected using spring suspension pins.

FIG. 1 illustrates a multipart rotor 1 as used for a hydraulic camshaft adjuster. Rotor 1 is a first exemplary embodiment, and includes two rotor partial bodies 2 which abut one another at a separating plane 3, clearly apparent in FIG. 3, and which together define hydraulic medium-conducting channels 4. Hydraulic medium-conducting channels 4 are present in separating plane 3. Separating plane 3 is oriented perpendicularly with respect to the axial direction of rotor 1. Rotor partial bodies 2 may also be referred to as rotor halves. One rotor half is then used as the rotor main body, and the other rotor half is used as the first rotor secondary body.

Hydraulic medium-conducting channels 4 may also be referred to as oil channels when oil is used as hydraulic medium, as is usually the case. One hydraulic medium-conducting channel 4 then supplies a working chamber A, while the other hydraulic medium-conducting channel 4 supplies working chamber B. Eight hydraulic medium-conducting channels 4 are present, four of which supply a working chamber A and four of which supply a working chamber B. Every two working chambers, namely, a working chamber A and a working chamber B in each case, are part of a vane cell, which is divided by a radially inwardly protruding projection of a stator, not illustrated here.

Figure 4:
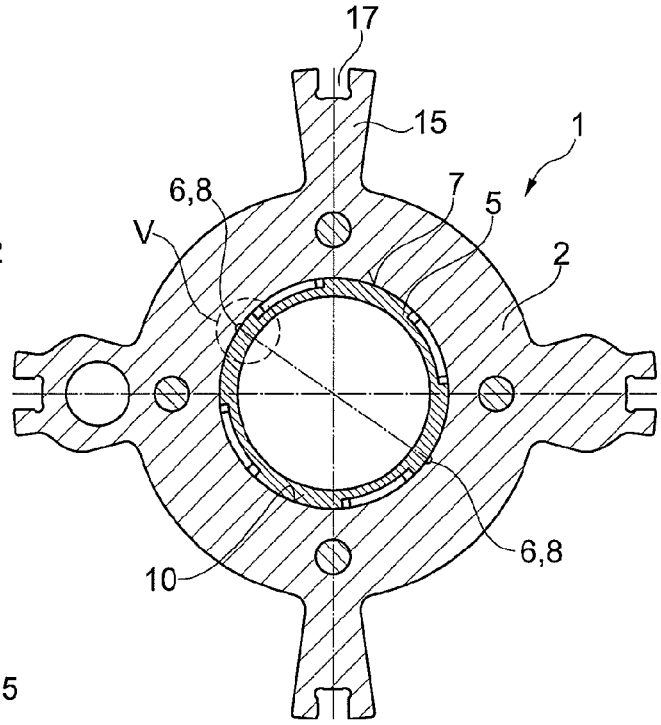
FIG. 4 shows a section along line IV from FIG. 3.
Figure 5:
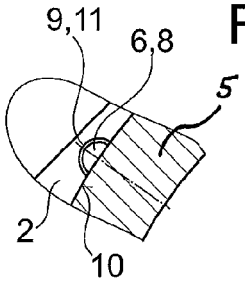
FIG. 5 shows an enlargement of area V from FIG. 4.

A rotor additional body 5 is inserted in the area of separating plane 3, in contact with both rotor partial bodies 2. Rotor additional body 5 may also be referred to as an oil distributor sleeve or oil distribution sleeve. It is preferably not inserted into rotor partial bodies 2 in a floating manner, although this is possible, but, rather, is held in a rotatably fixed manner on one or both rotor partial bodies 2 via a form-fit connection. The anti-twist protection is achieved via anti-twist elements 6, as is particularly clearly apparent in FIGS. 4 and 5.

Two anti-twist elements 6 which are offset by 180° are present on outer circumferential surface 7 of rotor additional body 5. These anti-twist elements 6 are designed as integral projections 8, and have a domed shape which engages with anti-twist counterelements 9 of at least one of the rotor partial bodies 2 at its inner circumferential surface 10. Anti-twist counterelements 9 are two concavely shaped depressions 11.

Anti-twist counterelements 9 may be present on both rotor partial bodies 2, and together or individually may accommodate one anti-twist element 6.

Returning to FIG. 1, reference is made to the use of four pins 12, three of which have a width that is greater than that of rotor 1, and one pin that is much shorter. The width is measured in the axial direction, and could also be referred to as the height. The shorter of the four pins is also referred to as short pin 13, and is used only for anti-twist protection and/or axial securing of the two rotor partial bodies 2 with respect to one another.

Longer pins 12 are designed as spring suspension pins 14, and are used for supporting/guiding/fastening a mechanical restoring spring, not illustrated here. The individual parts, i.e., the two rotor partial bodies 2 and rotor additional body 5, may be connected via caulkings and/or axial projections which engage with corresponding recesses, similarly as in EP 2 300 693 B1. The contents disclosed in the cited publication with regard to connection techniques are hereby incorporated herein.

Figure 2:
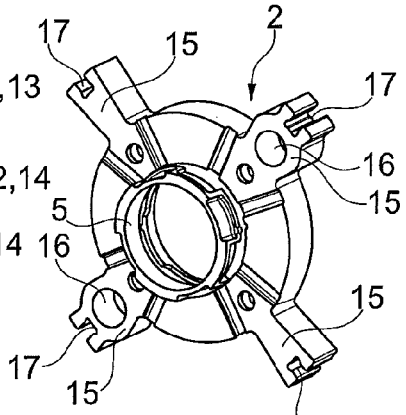
FIG. 2 shows a perspective view of one of the two rotor partial bodies of the rotor configuration from FIG. 1, with a rotor additional body, the rotor additional body configuration designed as an oil distribution sleeve being inserted with an angled orientation into one of the two rotor halves/rotor partial bodies.

As is clearly apparent in FIG. 2, rotor 1 has four vanes 15. Holes 16 are present in two of the vanes 15 to allow accommodation of a locking pin. Thus, a locking pin is accommodated in a borehole. A second, smaller borehole is used for imbalance correction. Grooves 17 are formed at the radial outer end faces of vanes 15, into which sealing elements such as elastic strips are introducible. However, these sealing elements are not illustrated here.

Figure 6:
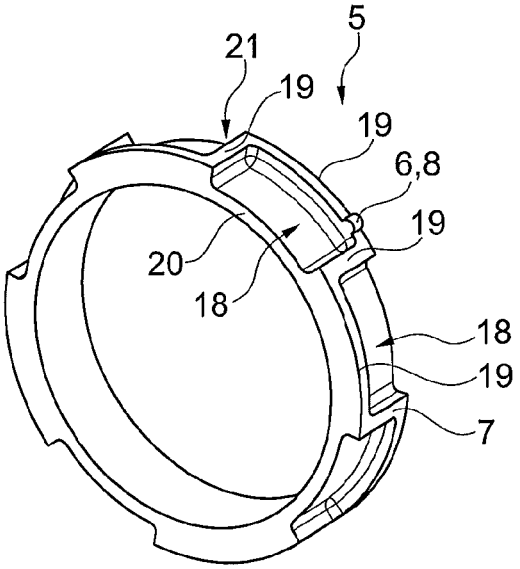
FIG. 6 shows a perspective view only of the oil distribution sleeve/the rotor secondary body, with an anti-twist element at the outer diameter, multiple anti-twist elements being usable at regular intervals.

Only rotor additional body 5, which includes oil-conducting pockets 18 between ribs 19 on its circumferential surface 7, is apparent in FIG. 6. While an oil-conducting pocket 18 is open toward a first end face 20 in the absence of a rib present there, oil-conducting pocket 18 adjoining same is open with respect to opposite, second end face 21. Anti-twist element 6 is positioned adjacent to second end face 21.

Figure 7:
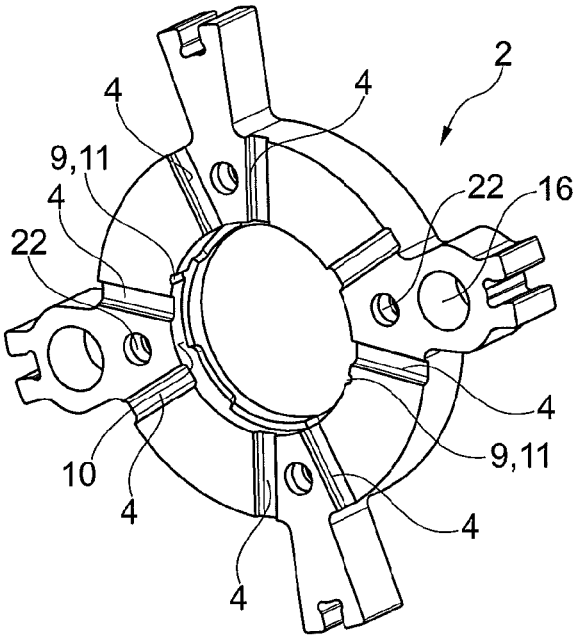
FIG. 7 shows a rotor partial body/a rotor half with a recess for accommodating the anti-twist element of the oil distribution sleeve, and with four axial oil-conducting counterpockets which cooperate with oil-conducting pockets of the oil distribution sleeve and ensure an oil supply to the rotor.

One of the two rotor partial bodies 2 is illustrated in FIG. 7 and, as is clearly apparent, includes anti-twist counterelements 9 in the form of curved depressions at inner circumferential surface 10. Fixing holes 22 are provided, offset from holes 16 with respect to the center axis of rotor partial body 2, for accommodating pins 12. Four uniformly distributed fixing holes 22 having circular cross sections are present. Holes 16 or fixing holes 22 are implemented as boreholes.

Figure 8:
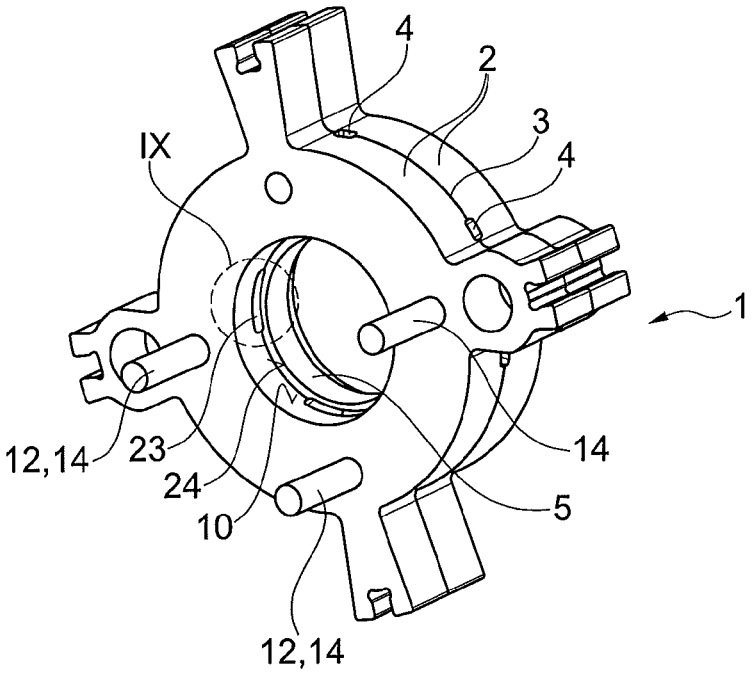
FIG. 8 shows a perspective view (three-dimensional view) of the rotor from FIG. 1, with 2×4 axial pockets/oil-conducting counterpockets which are used for supplying oil to working chambers A and B in a camshaft adjuster.
Figure 9:
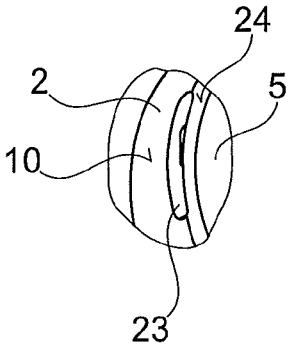
FIG. 9 shows an enlargement of area IX from FIG. 8.

Assembled rotor partial bodies 2 are apparent in FIG. 8. Oil-conducting counterpockets 23 are present on inner circumferential surface 10. The oil-conducting counterpockets are only partially concealed by rotor additional body 5, viewed in the radial direction, and protrude beyond an end face 24 of rotor additional body 5 in the axial direction.

Figure 10:
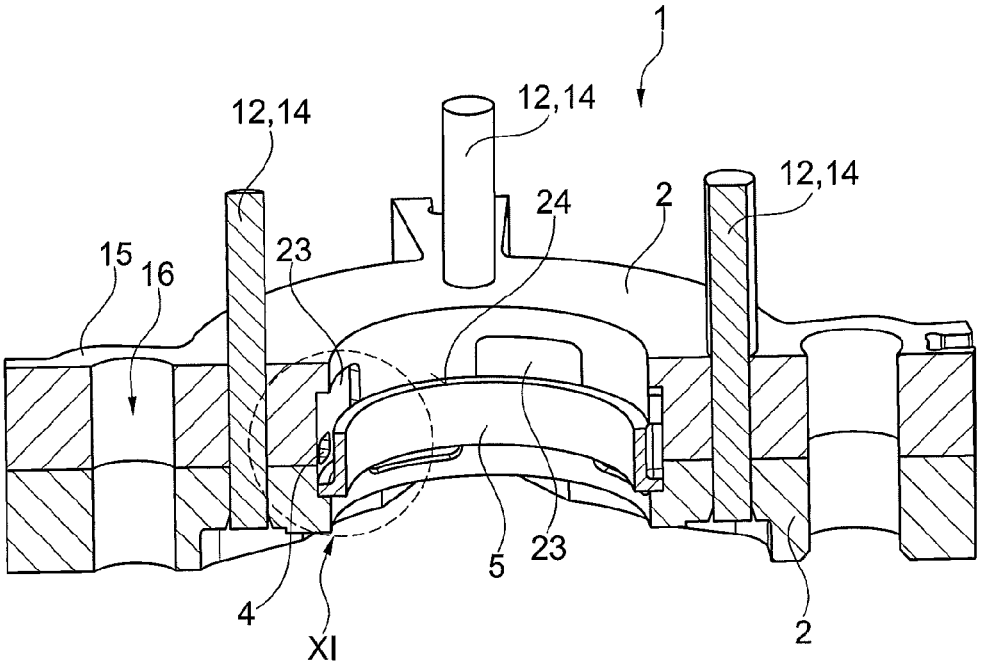
FIG. 10 shows a perspective view of the rotor from FIG. 1 in cross section, with 2×4 oil-conducting counterpockets for supplying oil to working chambers A and B in the camshaft adjuster, which extend approximately beyond an edge of the rotor additional body/the oil distribution sleeve in the axial direction.
Figure 11:
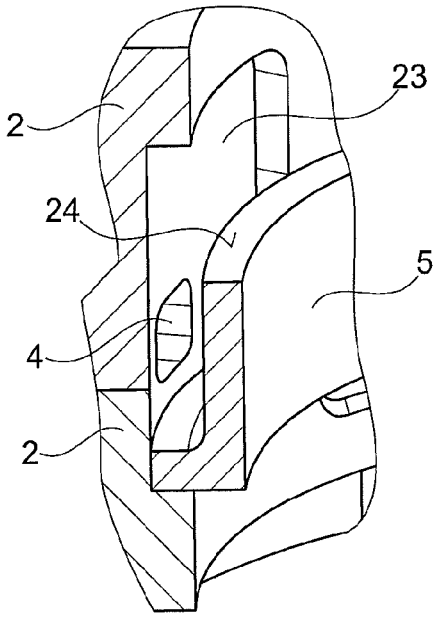
FIG. 11 shows an enlargement of area XI from FIG. 10.
Figure 12:
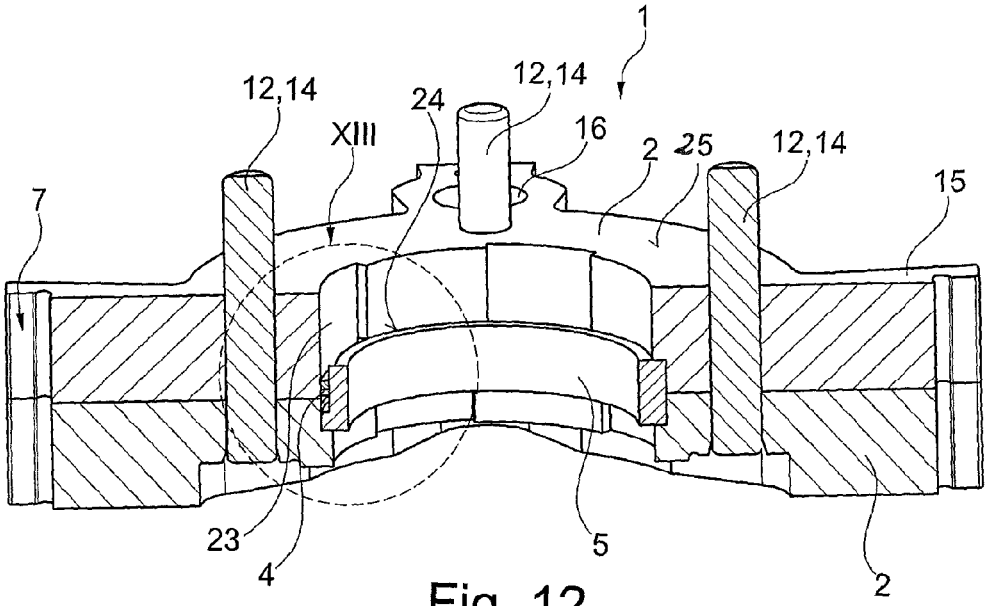
FIG. 12 shows another specific embodiment comparable to the specific embodiment illustrated in FIG. 10, but with oil-conducting counterpockets extending further in the axial direction, namely, to the free end face of the rotor partial body.
Figure 13:
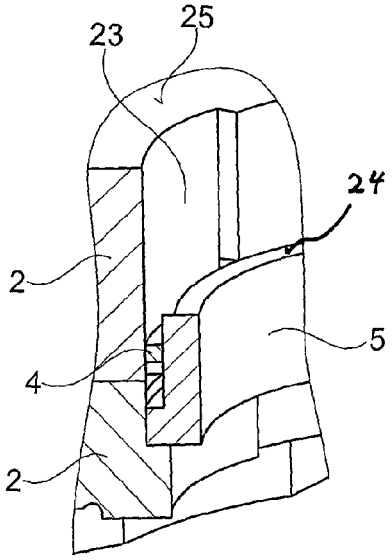
FIG. 13 shows an enlargement of area XIII from FIG. 12.

While oil-conducting counterpockets 23 in FIGS. 10 and 11 have a relatively short axial design, oil-conducting counterpockets 23 are much longer in the specific embodiment in FIGS. 12 and 13. End face 24 of rotor additional body 5 is either first end face 20 or second end face 21 of rotor additional body 5. In the specific embodiment according to FIGS. 12 and 13, the oil-conducting counterpockets extend in the axial direction to a rotor partial body end face. This rotor partial body end face 25 is present either at the one rotor partial body 2 or at the other rotor partial body 2. One variant is illustrated in FIGS. 14 and 15, which illustrate the view from the camshaft side and from the side facing away from the camshaft, respectively.

The special feature here is that two journal receptacles 26 are present in a rotor partial body 2, with which journals 27 of the other rotor partial body 2 engage in a form-fit and/or force-fit manner. This is possible in addition to or as an alternative to caulking approaches, pinning approaches, or integral bond connections.

Figure 14:
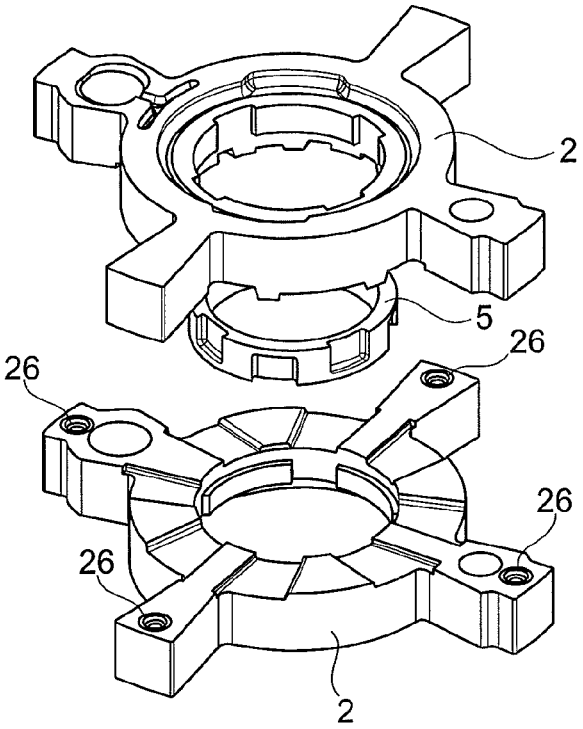
FIGS. 14 and 15 show one specific embodiment in an exploded view, from the side of the camshaft and from the side facing away from the camshaft, respectively.
Figure 15:
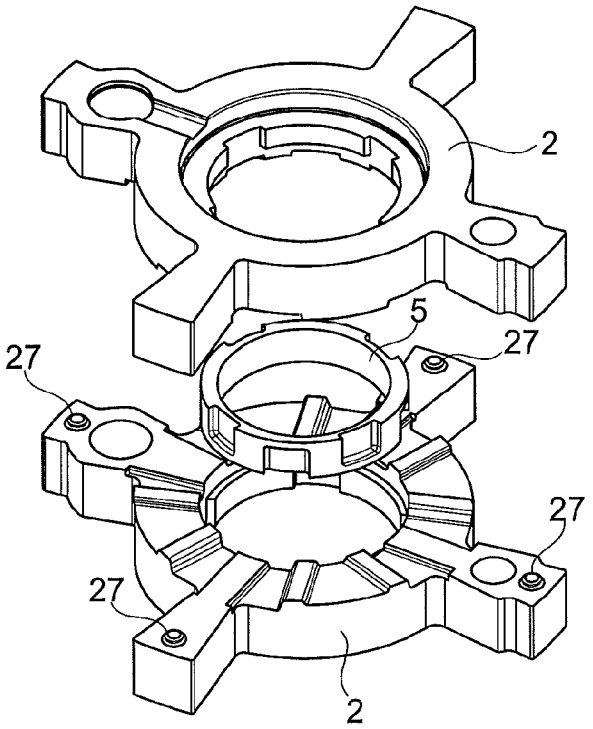
Figure 16:
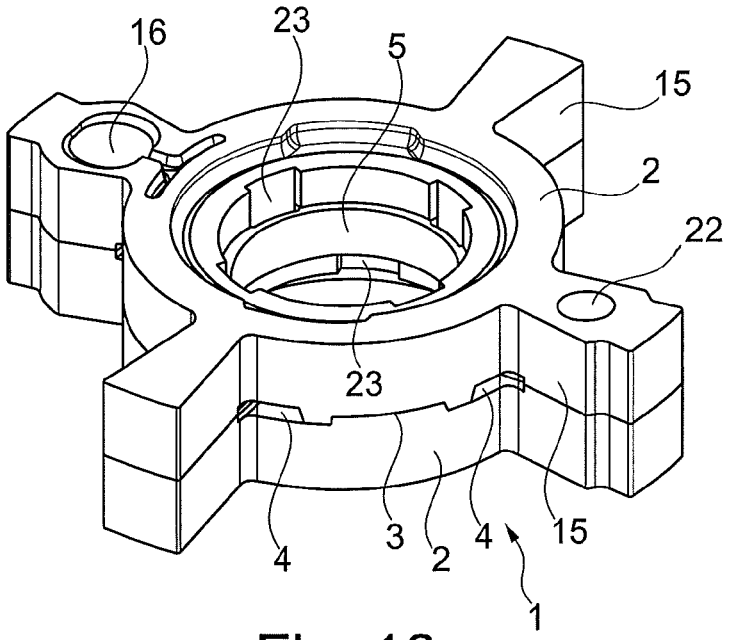
FIGS. 16 and 17 show assembled perspective depictions according to the exploded view from FIGS. 14 and 15.
Figure 17:
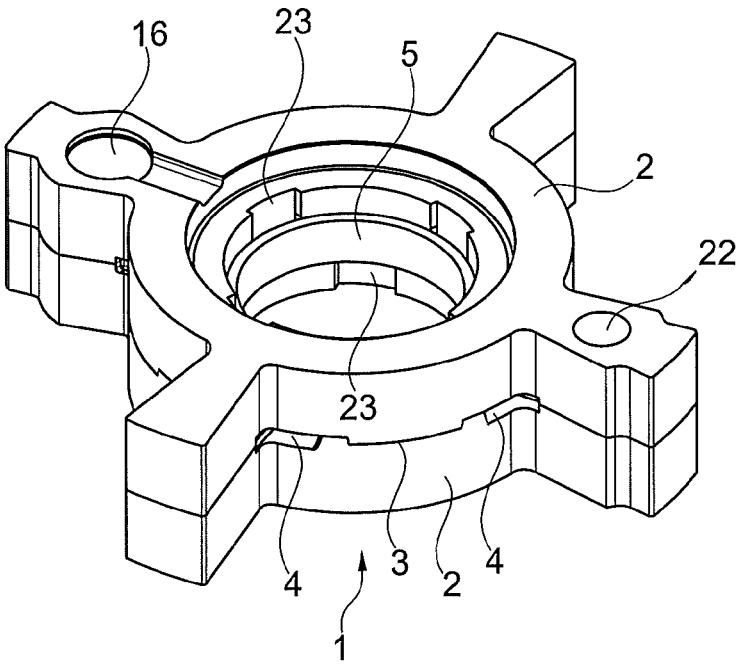

FIGS. 16 and 17 illustrate views from the camshaft side and from the side facing away from the camshaft on assembled rotors 1, respectively, as shown in FIGS. 14 and 15. Also clearly apparent are individual hydraulic medium-conducting channels 4 for supplying the particular working chambers A and B. The two rotor partial bodies 2 are designed mirror-symmetrically with respect to separating plane 3. Journals are provided on the one rotor partial body 2 in the axial direction, and engage with identical recesses on the other rotor partial body 2.

LIST OF REFERENCE NUMERALS

1 rotor
2 rotor partial body
3 separating plane
4 hydraulic medium-conducting channel
5 rotor additional body
6 anti-twist element
7 outer circumferential surface
8 projection
9 anti-twist counterelement
10 inner circumferential surface
11 depression
12 pin
13 short pin
14 spring suspension pin
15 vane
16 hole/locking borehole/borehole
17 groove
18 oil-conducting pocket
19 rib
20 first end face of the rotor additional body
21 second end face of the rotor additional body
22 fixing hole/borehole for imbalance correction
23 oil-conducting counterpocket
24 end face of the rotor additional body
25 rotor partial body end face
26 journal receptacle
27 journal

What is claimed is:

1. A multipart rotor for a hydraulic camshaft adjuster, the rotor comprising:

two rotor partial bodies resting against one another on a separating plane oriented perpendicularly with respect to the axial direction, and the two rotor partial bodies together defining hydraulic medium-conducting channels extending in the separating plane; and a rotor additional body conducting hydraulic medium in a targeted manner from opposite axial directions to different ones of the hydraulic medium-conducting channels;

the rotor additional body or at least one anti-twist element acting in a form-fit manner being secured in a rotatably fixed manner to one or both rotor partial bodies.

2. The rotor as recited in claim 1 further comprising the anti-twist element, the anti-twist element being designed as an integral projection or recess at an outer circumferential surface of the rotor additional body cooperating in a form-fit manner with an anti-twist counterelement of one or both rotor partial bodies having a corresponding geometric design.

3. The rotor as recited in claim 1 wherein the rotor additional body has, or the two rotor partial bodies have, a ring-like design.

4. The rotor as recited in claim 1 wherein the two rotor partial bodies are fitted together congruently in the axial direction, and the rotor additional body is situated concentrically and radially within the two rotor partial bodies.

5. The rotor as recited in claim 1 wherein the rotor additional body includes oil-conducting pockets at an outer circumference, the pockets having a design open in alternation over the outer circumference, facing in different axial directions.

6. The rotor as recited in claim 1 wherein one of the rotor partial bodies includes at least one oil-conducting counterpocket, in the form of a depression, the counterpocket being at an inner circumferential surface and leading to a hydraulic medium-conducting channel.

7. The rotor as recited in claim 6 wherein both rotor partial bodies include one of the at least one oil-conducting counterpocket oriented in different or opposite axial directions away from the hydraulic medium-conducting channel.

8. The rotor as recited in claim 6 wherein the oil-conducting counterpocket extends beyond an axial edge of the rotor additional body.

9. The rotor as recited in claim 6 wherein the oil-conducting counterpocket extends by approximately 10% to 100% or more of the distance from an edge of a hydraulic medium-conducting channel remote from the separating plane to a front edge of the rotor additional body present on this side of the separating plane, in the direction of the front side of one of the rotor partial bodies present on this side of the separating plane.

10. The rotor as recited in claim 6 wherein the oil-conducting counterpocket extends to a front side of the rotor partial body remote from the separating plane, the oil-conducting counterpocket being formed at the separating plane.

* * * * *